US006442780B1

(12) United States Patent
Phillips et al.

(10) Patent No.: US 6,442,780 B1
(45) **Date of Patent: *Sep. 3, 2002**

(54) MATTRESS WITH SEMI-INDEPENDENT PRESSURE RELIEVING PILLARS

(75) Inventors: Bruce Phillips; Blane Sanders, both of San Antonio, TX (US)

(73) Assignee: KCI Licensing, Inc., San Antonio, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/522,145

(22) Filed: Mar. 9, 2000

(51) Int. Cl.[7] ..... A47C 27/14; A61G 7/057
(52) U.S. Cl. ..... 5/730; 5/734; 5/740; 5/738
(58) Field of Search ..... 5/727, 730, 740, 5/736, 901, 900.5, 731, 734

(56) References Cited

U.S. PATENT DOCUMENTS

| | | | | |
|---|---|---|---|---|
| 3,512,190 A | | 5/1970 | Buff | |
| 3,574,873 A | | 4/1971 | Weinstein | |
| 3,828,378 A | * | 8/1974 | Flam | 5/730 |
| 3,846,857 A | * | 11/1974 | Weinstock | 5/740 |
| 3,885,257 A | | 5/1975 | Rogers | |
| 4,042,987 A | | 8/1977 | Rogers | |
| 4,070,719 A | | 1/1978 | Morgan | |
| 4,110,881 A | | 9/1978 | Thompson | |
| 4,580,301 A | | 4/1986 | Ludman et al. | |
| 5,025,519 A | * | 6/1991 | Spann et al. | 5/730 |
| 5,127,119 A | | 7/1992 | Rogers | |
| 5,160,785 A | | 11/1992 | Davidson, Jr. | |
| 5,179,742 A | * | 1/1993 | Oberle | 5/740 |
| 5,960,497 A | * | 10/1999 | Castellino et al. | 5/730 |
| 6,286,166 B1 | * | 9/2001 | Henley et al. | 5/730 |

FOREIGN PATENT DOCUMENTS

| | | | | |
|---|---|---|---|---|
| GB | 2274054 | * | 7/1994 | 5/736 |

* cited by examiner

*Primary Examiner*—Michael F. Trettel

(57) ABSTRACT

A foam core cushion mattress assembly provides semi-independent foam pillars on the upper surface of the mattress. The mattress may be unitary, or comprise three cushioning components: a base, a body support cushion, and a foot cushion insert. A removable fabric cover envelops the mattress assembly. The body support cushion is constructed from a flat, rectangular solid, foam element whose upper surface is cut into an array of rectangular solid pillars, preferably by a hot wire cutting method. The array of rectangular solid pillars is grouped into a central array comprising pillars with generally square top surfaces and edge rows of rectangular solid pillars having rectangular top surfaces. The depth of the hot wire cuts into the surface of the body support cushion is preferably approximately one-half the overall thickness of the body support cushion or approximately three fourths of the length of the shortest face of the pillar. A zippered fabric cover removably envelops the assembled cushioning components. The resultant structure defines a plurality of semi-independently compressible pillars, which supports a reclining, or in the supine, position on the mattress. Methods of manufacture, and treatment and alleviation of decubitus ulcer formation are also presented.

2 Claims, 5 Drawing Sheets

MATTRESS WITH SEMI-INDEPENDENT PRESSURE RELIEVING PILLARS

BACKGROUND OF THE INVENTION

1. Field of the Invention

The present invention relates generally to mattresses for use in association with beds and other support platforms. The present invention relates more specifically to a foam containing mattress assembly having a pressure relieving structure comprising semi-independent foam pillars, a method of manufacture thereof, and a method of treating decubitus ulcers therewith.

2. Description of the Related Art

Patients and other persons restricted to bed for extended periods incur the risk of decubitus ulcers formation. Decubitus ulcers (also referred to as bed sores, pressure sores or pressure ulcers) are formed due to an interruption of blood flow in the capillaries below skin tissue due to pressure against the skin. The highest risk areas for such ulcer formation are those areas where there exists a bony prominence, which tends to shut down capillaries sandwiched between the bony prominence and the underlying support surface. When considering the redistribution of body weight and the formation of decubitus ulcers, historically, the trochanter (hip) and the heels are the body sites of greatest concern because these are the areas most frequently involved in decubitus ulcer formations which afflict bedridden or otherwise immobile patients. Generally, as is well known in the art, blood flows through the capillaries at an approximate pressure of 32 millimeters of mercury (mm Hg). This pressure can be somewhat lower for elderly individuals or individuals in poor health or with nutritional deficiencies. Once the net external pressure on a capillary exceeds its internal blood pressure, occlusion occurs, preventing the afflicted capillaries from supplying oxygen and nutrition to the skin in close proximity thereto. Tissue trauma may then set in with the resultant tissue decay and ulcer formation. Movement of the afflicted individual into different positions generally helps in restoring blood circulation into the effected areas. However, such movement is, either not always possible or is in some instances neglected.

Additionally, even shorter bed rest periods by healthy individuals on a mattress that does not relieve or reduce the pressure exerted on the user is likely to be considered uncomfortable. Conversely, a mattress that does not provide sufficient firmness or support is also likely to be uncomfortable.

In attempting to avoid the problem of decubitus ulcers in bedridden individuals and to provide greater user comfort to those spending substantial amounts of time in bed, a variety of techniques and devices have been used in the past. For instance, air mattress overlays, air mattresses (static and dynamic), water mattress overlays, water mattresses, gel-like overlays, specialty care beds, foam overlays and various types of other mattresses have been introduced in an attempt to avoid the above noted problems with decubitus ulcers and general user discomfort. Some relatively expensive motorized and/or dynamic devices have been quite successful in solving these problems. However, their cost and relative complexity drastically reduce the breadth of market to which such devices can be effectively offered.

Therefore, to date, no non mechanized device has been wholly successful in meeting these needs, at a cost which, in view of government cutbacks in such programs as Medicare, and stringent, and in some case draconian, cost restrictions, would make such devices readily accessible. The meeting of these needs, in a reasonably economical fashion, is the goal of the present invention.

BRIEF SUMMARY OF THE INVENTION

The present invention provides a non-mechanized mattress assembly that possesses a plurality of semi-independent foam pillars comprising an upper portion of the mattress. This mattress assembly may be fabricated from a single piece of deformable material, such as foam, or, in the presently preferred embodiment, comprises a plurality of core components, for example, a foam base, a foam body support cushion, and a foot cushion insert, which are placed in a contiguous operatively coactive manner. In a multiple component embodiment, these components may be held in place by appropriate contouring of their structures, may be bonded together, or may be fixedly attached in any other suitable manner as is presently known in the art, so as to fix their relative orientation.

Once so placed, or assembled, or in the single component embodiment, after fabrication, a removable fabric cover envelops this mattress core assembly. Most usually, the completed mattress core is generally rectangular in shape.

In the multiple component embodiment, the base component supports the other elements of the mattress core, and, therefore has the same lateral and longitudinal dimensions, as does the entire assembled mattress core. The overall height of the covered mattress assembly, in either the single component, or the multiple component embodiment will generally approximate the thickness of a present day medical mattress, from about 5 to about 7 inches. The height (or depth) of the base generally ranges from about 1 to about 2 inches, except as may be necessitated by any applicable contouring requirements. The base is less deformable than is either the body support cushion or the foot support insert. Though the base is generally symmetrical, during the process of placing the components into alignment, one of the short edges of the base is designated as the top edge of the base, and thereby also of the assembled mattress core.

The body support cushion component is made from a rectangular solid foam element whose upper surface is cut into a plurality of solid pillars, which are most commonly arranged in some systematic manner. This cushion is longitudinally symmetrical about its central longitudinal axis. In the presently preferred embodiment, the rectangular solid pillars are grouped into a central array comprising pillars with generally square top surfaces, and edge rows of rectangular solid pillars having rectangular top faces. Making repeated cuts into the top of the body cushion creates these pillars. The depth of the cuts into the surface of the body support cushion is preferably approximately one half to three quarters of the shortest dimension of the face of the pillar, or roughly one third to two thirds the overall thickness of the body support cushion, in the multi component embodiment.

The foot cushion insert, in the multi component embodiment, is a generally trapezoidal geometric solid comprised of polyurethane foam, or other suitable material, which could include air, or other fluid. This trapezoid is oriented so that its thickness is greater in that portion proximate to the body support cushion, and lesser in that portion remote from the body support cushion, thereby resulting in the insert having a thick edge and a thin edge, and a downward slope from the direction of the designated top edge of the mattress, to the designated bottom edge of the mattress.

Viewed from the top, the trapezoid is substantially rectangular in shape. The insert is, most usually, more easily deformable than both the base and the body support cushion. The same slope will generally be fabricated into the single component embodiment, in the same relative location.

The multiple component embodiment of the present invention is assembled in the following manner. The base is placed in the desired orientation. The body support cushion is aligned so that the top edge of the cushion is in registry with the selected top edge of the base. The foot insert is then placed so that the thick edge of the insert abuts the bottom edge of the body support cushion, the thin edge of the insert is in registry with the bottom edge of the base, and the sides of the assembled cushion are in substantial registry with the sides of the base. The base, body support cushion, and insert, are then secured in position.

A zippered fabric cover then removeably envelops the assembled mattress core. The resultant structure defines a plurality of semi-independently compressible pillars that provide appropriate support to the upper portion of a person in a supine, or reclining position on the mattress, and an inclined uniform surface that supports the feet and connective portions of the person in question.

An object of the present invention is to provide a non-mechanized pressure-reducing mattress that provides therapeutic benefits to a person confined thereto for a substantial period.

Another object of the present invention is to provide a mattress, which prevents or minimizes capillary damage to those who are confined thereto.

A further object of the present invention is to provide a reasonably economical pressure relieving mattress that provides therapeutic benefits to a mammal confined thereto for a substantial period.

Yet another object of the present invention is to provide a relatively lightweight pressure-relieving mattress.

A still further object of the present invention is to provide a mattress, that, when hot wires are used to cut the slots which create the semi-independent pillars, is easy and relatively affordable to manufacture.

Still another object of the present invention is to provide a method of alleviating or minimizing the occurrence of decubitus ulcers on a person confined to a bed for a significant period of time, by the use of the semi-independent pillar containing mattress disclosed herein.

A yet further object of the present invention is to provide a decubitus preventing or alleviating mattress containing semi-independent pressure relieving pillars which is more economical than those of equal efficacy known to the prior art.

These and still further objects as shall hereinafter appear are readily fulfilled by the novel pressure relieving mattress of the present invention in a remarkably unexpected manner as will be readily discerned from the following detailed description of an exemplary embodiment thereof especially when read in conjunction with the accompanying drawings in which like parts bear like numerals throughout the several views.

DETAILED DESCRIPTION OF THE PREFERRED EMBODIMENTS

Figure 1:
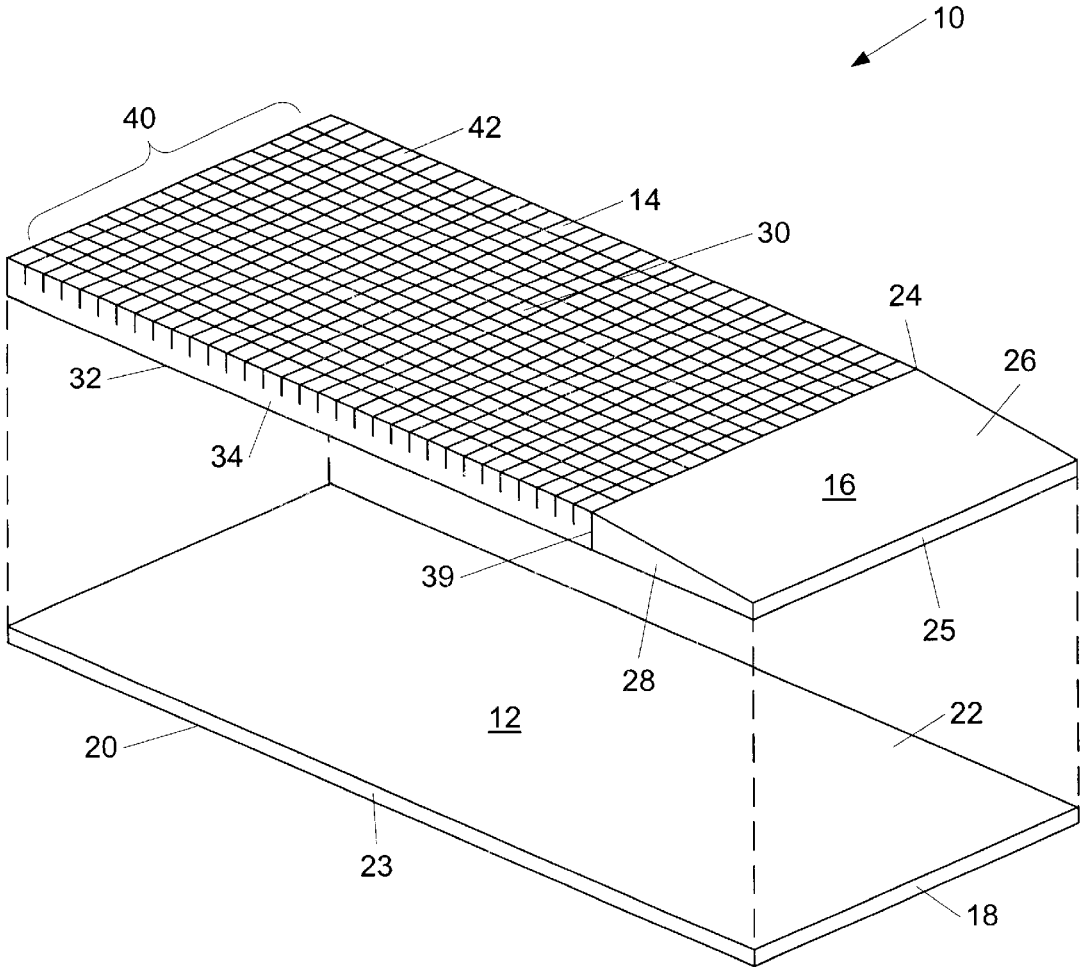
FIG. 1 is an exploded perspective view of the cushioning components of the mattress of the present invention.

The cushioning components of the first embodiment 10 are displayed in an exploded view shown in FIG. 1. The three basic components of mattress assembly 11 include foam base 12, foam body support cushion 14, and foot cushion insert 16.

Foam base 12 is a substantially rectangular solid structure having end walls 18 sidewalls 20, surfaces 22, and body 23. The dimensions of foam base 12 viewed from above may be similar to those of any standard mattress, particularly medical mattresses, but are preferably approximately 35 inches wide by 80 inches long. The thickness of foam base 12 may vary according to the needs of the application and would range anywhere from about one inch to about two inches, or even more than two inches. In addition, the choice of foam material for base 12 permits variations in the overall resiliency of the mattress. In the preferred embodiment, foam base 12 is presently preferably constructed from a polyurethane core material having 1.8 lb. per cubic foot density and 33 lb. IFD (Indention Force Deflection). However any suitable similar foam presently used in this field of endeavor may be used within the spirit of the present invention.

As shown in FIG. 4, foot insert cushion 16 comprises a generally trapezoidal solid having thick end wall 24, thin end wall 25, top surface 26, and sidewalls 28. In the preferred embodiment, foot cushion (16) is constructed from a polyurethane viscoelastil foam core material having 3.8 lb. density and 10 lb. IFD. However, any material possessing the desired softness and deformability characteristics may be employed within the spirit of the present invention. As viewed in FIG. 1 cushion 16, when viewed from either the top or the bottom, is generally rectangular in shape.

As shown in FIG. 2 the detailed structure of foam body support cushion 14 is described below. Body support cushion 14 is a generally rectangular solid foam element having top surface 30, bottom surface 32, body 34, side walls 36, top end wall 38, and bottom end wall 39.

Body 34 is cut, into a plurality of foam pillars including central pillars 40, and edge pillars 42. The cuts into body 34 which define pillars 40, 42 begin at the top of surface 30 of body 34, and extend approximately ½ of the way from top surface 30 towards bottom surface 32. The degree of independence of the pillars depends, at least in part, upon the depths of the cuts used to create these pillars. Plainly if the cuts extend 100% of the way through body 34, the pillars would be substantially 100% independent. Equally plainly, if the cuts extend a minuscule percentage of the way through body 34, the pillars would be substantially dependent such that compression or movement of one pillar is readily transmitted to the adjacent pillar. Therefore, a cut that extends part way into body 34 from top surface 30 provides pillars 40, 42, with a limited amount of independence. Applicant believes, but does not desire to be bound by, that the independence of such pillars is also related to the relationship between the dimension of the face of a pillar, 40, 42, having the smallest value, and the depth of such a cut. Applicant believes that in certain circumstances, the depth of the cuts could range from about one sixth to about five sixths of the depth of the body cushion 14, and that more optimally, the depth of the cuts could range from about 25% to about 75% of the depth of body cushion 14, or also about 50% of to approximately 100% or more, of the face dimension noted above.

In the presently preferred embodiment pillars 40 are substantially square, while pillars 42 are substantially rectangular. Pillars 42 are adjacent sidewalls 36, while pillars 40 are not adjacent to the longitudinal sidewalls 36. In the preferred embodiment, body support cushion 14 is constructed from a polyurethane core material having 1.8 lb. density per cubic foot, and 21 lb. IFD. This provides a softer top layer compared to the firmer under layer comprising foam base 12. However many such foams are currently available, and could well be used within the spirit of the present invention.

Each of the three cushioning components of foam mattress assembly 11 are secured one to another in a manner sufficient to prevent layer shifting between the components, after they have been placed in the proper arrangement. Thick end wall 24 of insert 16 is placed in intimate contact with bottom end wall 39 of body support cushion 14. In the presently preferred embodiment, this configuration has the result of causing the top surface 26 of foot insert 16 to slope downward away from body cushion 14. Body support cushion 14 and insert 16 are both placed atop foam base 12, while the intimate contact between walls 29 and 39 is either maintained or reestablished prior to securing theses to components in place.

Such securing could be accomplished in a variety of manners well known in the art. For example the cushioning components could be contoured so as to allow for a force fit intimate contact between components. In the presently preferred embodiment, the cushioning components could also be bonded together in the proper configuration.

This bonding would typically take the form of an adhesive agent that does not alter the foam core shape or the cushioning performance of the foam components. In addition, the bonding agent should not emit appreciable odors after curing and no bonding agent residue should extend beyond the outer edges of the foam core components. A variety of bonding agents known in the industry are suitable for assembling the mattress core 11 in the manner described.

Reference is now made to FIG. 2 for a detailed description of the structure of body support cushion 14 of the present invention. FIG. 2*a* is a top plan view showing the array of foam pillars exposed on top surface 30 of body support cushion 14. In this view the array of central support pillars 40 is seen intermediate edge row pillars 42. In this view it can also be seen that central support pillars 40 have a generally square upper surface, while edge row support pillars 42 have a generally rectangular upper surface. The larger top surfaces afforded edge row pillars 42 provide enclosing support to the patient positioned within a central area of the mattress. The larger pillars 42 at the longitudinal edges of the mattress incorporated within the present embodiment 10 tend to contain the patient within the central portion of the mattress over the smaller square-faced central foam pillars 40.

In the presently preferred embodiment, the array of central support pillars 40 positioned along the center of support cushion 14 comprises 32 columns by 14 rows for a total of 448 discrete support pillars. The two sets of edge row pillars 42 which border central support pillars 40, each comprise 32 discrete support pillars. Central support pillars 40 present 2 inch by 2-inch top surfaces in the preferred embodiment as described in more detail below; edge row pillars 42 present 2 inch by 3.5 inch top surfaces. These dimensions provide overall dimensions of approximately 35 inches by 64 inches for body support cushion 14. Variations are possible in the overall size of support cushion 14 by adding or removing rows of central support pillars 40 to vary the width of embodiment 10, and/or by adding or removing columns of central support pillars 40 bounded by edge row pillars 42 to vary the length thereof. As is referenced elsewhere herein, the size of the pillars 40 from the plan view may vary to some degree, although approximately two inches by two inches plus or minus about a half inch is preferred, though central pillars ranging from about 1 inch square to about 4 inches square could be used in various applications of the present invention, particularly if the mattress thickness is increased, for example to possibly 9 inches for a home health care product, or even possibly to as much as 12 inches for a hyperbaric mattress.

Figure 2A:
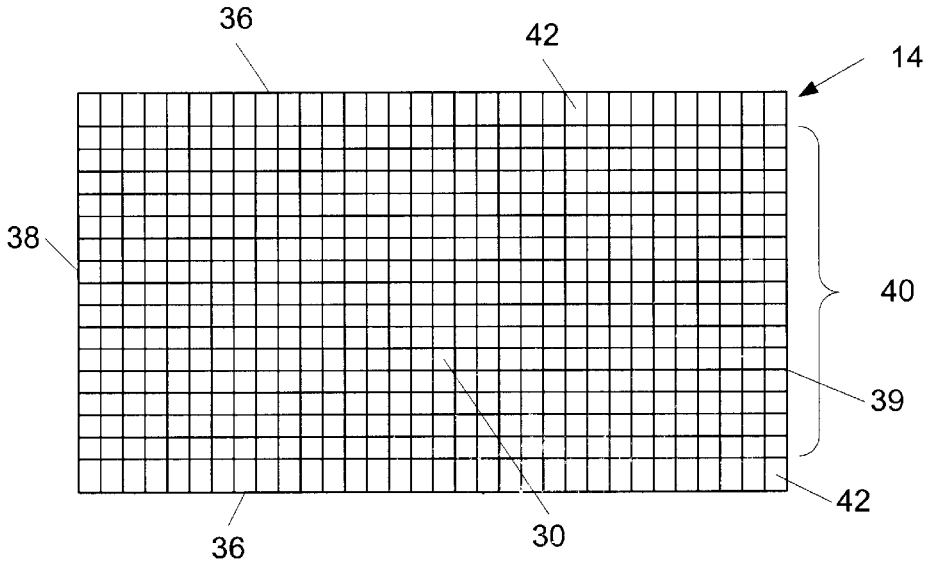
FIG. 2*a* is a top plan view of the body support cushion component of the present invention.
Figure 2B:
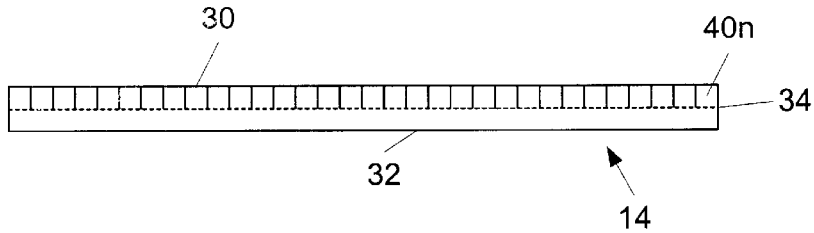
FIG. 2*b* is a side view of the body support cushion component of the present invention.

FIG. 2*b* is a side view of the structure of body support cushion 14 of the present invention showing the manner in which the array of central support pillars 40 are cut into top surface 30 of body support cushion 14. The dashed line in FIG. 2*b* indicates the approximate depth to which the cuts in top surface 30 are made into the solid rectangular body structure 34 of support cushion 14.

An exemplary row of foam pillars 40 is displayed.

Figure 2C:
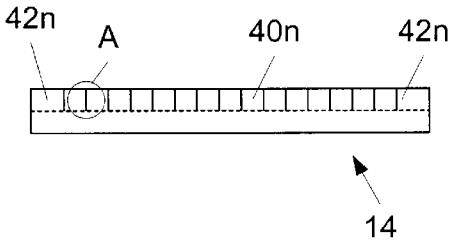
FIG. 2*c* is an end view of the body support cushion component of the present invention.

FIG. 2*c* is an end view of support cushion 14 of the present invention showing a complete column of pillars comprising central support foam pillars 40, and two of edge row pillars 42. This dashed line also indicates the approximate depth of the cuts made in order to form the semi-independent foam pillars 40.

Figure 2D:
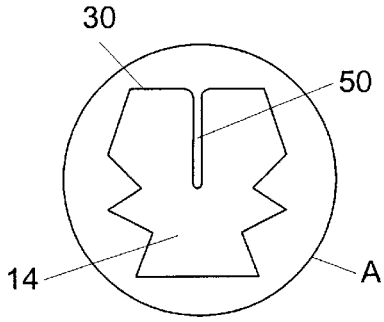
FIG. 2*d* is a detailed view of a cut made into the body support cushion component of the present invention.

FIG. 2*d* is a detail of section A shown in FIG. 2*c*, disclosing the manner in which slot 50 is made in the top surface 30 of body support cushion 14. The method of using a hot wire or an array of hot wires to make cuts into foam solids is well known in the art. The process includes heating a wire, typically with electrical current, and forcing the hot wire into a foam element in a manner that cuts a void of relatively narrow width into the foam core. In the present invention the array of cuts necessary to create the array of semi-independent foam pillars could be accomplished with a predefined array of hot wires or a movable hot wire that cuts in sequence each of the necessary slots in the top surface of the foam support cushion.

Although certain aspects of the present invention can be appreciated while still using a saw-cut foam the hot wire cutting technique is most preferred. One of the important advantages of utilizing hot wire cuts as opposed to cuts made with a saw, for the purpose of creating the slot in the top surface of the mattress, relates to the resultant structure walls of the foam pillars 40, 42. A saw cut generally leaves the walls of the foam pillars more jagged, or open-celled, for most types of foam. A hot wire cut will slightly sear (melt) and partially seal the walls of the foam pillars in the process of cutting the slot into the top surface of the foam core. In the preferred embodiment of the present invention, the most preferred width of the slot cut in this manner is between approximately 1/16'" and approximately 1/8". The slightly seared walls of the foam pillars that result from this process have a smoother surface than those that might result from cutting with a saw. Applicant believes that this smoother surface reduces the coefficient of friction between adjacent pillars 40, 42 and permits greater independent movement of one pillar of foam with respect to adjacent pillars. Applicant does not desire to be bound by this theory; however, saw cut structures of this geometry are thought to have an increased frictional coefficient between the walls of adjacent pillars. The present invention overcomes problems associated with this increased friction by utilizing a hot wire method for cutting the slots that create foam pillars 40, 42. Other cutting techniques (such as laser cutting techniques) that produce a smoother cut than a saw may be utilized in alternate embodiments.

Figure 3A:
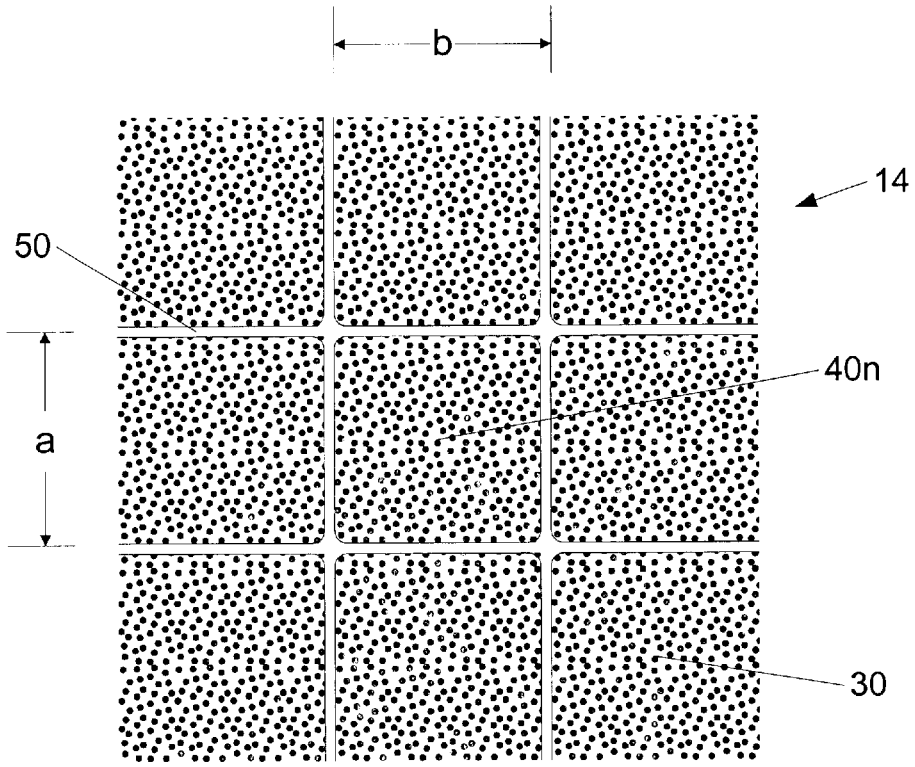
FIG. 3*a* is a detailed top plan view of the central pillars of the body support cushion component of the present invention.

The hot wire cutting process is also believed to obtain another unobvious benefit. Leaving the heated wire in place at the bottom of each slot for some interval after the time necessary to complete cutting the slot in question can incrementally increase the width of the slot at that location. This is believed to be particularly beneficial in the present invention in that the increased width in the base of the slots is believed to distribute the foam stress that would otherwise be concentrated at the bottom of each slot, which reduces the likelihood of tearing or other damage to the pillars. This should add to the durability of a mattress embodying the present invention, Reference is now made to FIG. 3*a* for a detailed view and description of the structure of foam pillar components 40 of the present invention. FIG. 3*a* is a plan view of the surface of body support cushion 14 showing the full upper surface of one foam pillar 40, and a partial view of eight adjacent foam pillars. In the preferred embodiment of the present invention, the upper surface of these central foam support pillars is substantially square in geometry.

Dimension a shown in FIG. 3*a,* comprises a fraction of the length of embodiment 10, and is therefore approximately equal to dimension b, which comprises a fraction of the width of embodiment 10. As indicated above, the width of slots 50 cut into upper surface 30 of body support cushion 14 is approximately 1/16'–1/8" in the preferred embodiment. Applicant believes that slots that are substantially larger than 1/8" may decrease the amount of the patient interface surface, and thereby increases the amount of interface pressure. Dimension a and dimension b in the preferred embodiment, that is for a medical mattress having the dimensions discussed above, are approximately 2" each, thereby providing a 2"×2" square upper surface for each foam pillar 40.

Figure 3B:
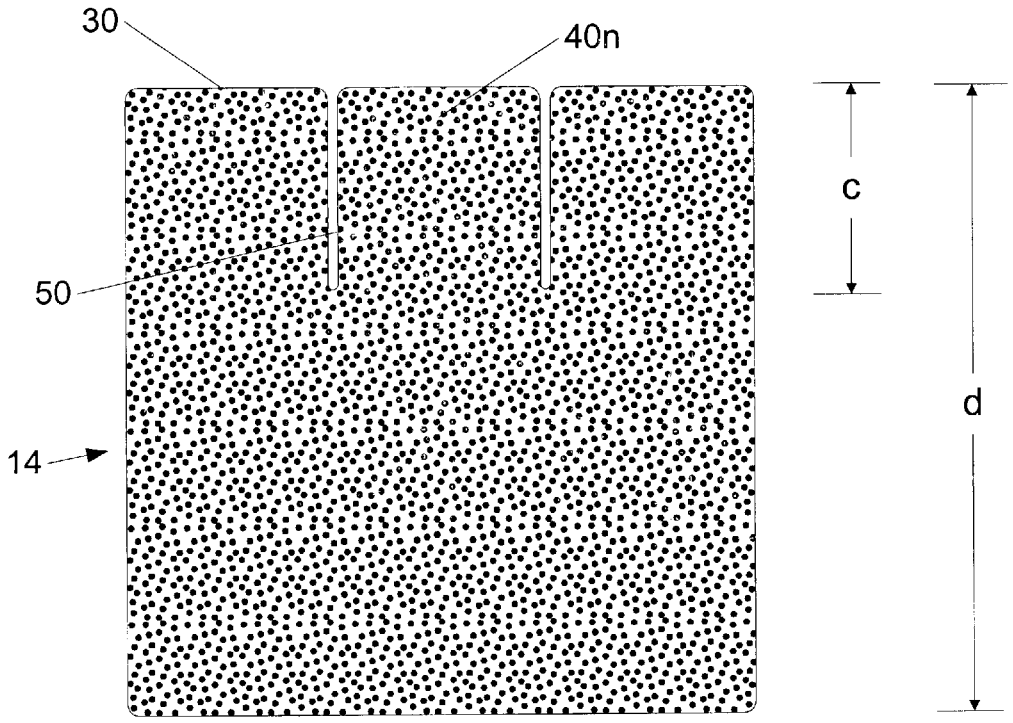
FIG. 3*b* is a detailed cross-sectional view of a number of the central pillars in the body support cushion component of the present invention.

FIG. 3*b* is a partial cross-sectional detailed view of body support cushion 14, again showing one complete foam pillar 40. In this view, the depth of slots 50, disclosed in the preferred embodiment shown as dimension c, is approximately 2". This is an appropriate depth for an overall thickness of body support cushion 14 having dimension d, which in the preferred embodiment is approximately 6". Preferably, the dimension c, should be from about ¾ of to even greater than the smaller of dimensions a and b to obtain optimum pressure relief. This would hold true for the multiple component embodiment, as well as the single component embodiment of the present invention.

A variety of dimensions are possible for those dimensions a and b shown in FIG. 3*a,* and those dimensions c and d shown in FIG. 3*b.* Applicant believes that the a:b ratio for central pillars 40 could range from about 1.5:1 to about 0.67:1 without materially affecting the efficacy of the present invention. Similarly the nominal a:b ratio for the edge pillars is approximately 0.56:1. Applicant believes that this could range from about 0.8:1 to about 0.28:1.

Applicant also believes that a graduated ratio, particularly where the a:b ratio is greatest about the longitudinal axis of the mattress assembly 11 could be employed, to provide even greater lateral support to the occupant of the embodiment 10. Plainly, the inverse of the a:b ratio could also be used within the spirit of the present invention.

In addition various shaped pillars could be employed if desired. For example, if the slots 50 were made with an array of wires, and the body cushion 14 were subjected to lateral compression during the cutting process, then the slots 50 would be in a curvilinear configuration. Further, the wires or wire array could be arranged to obtain almost any desired shape slots 50 and pillars 40, 42. For instance, rather than the one-eighth inch slot with an enlarged radius at its lower end (caused by leaving the hot wire in place), each slot could be shaped in teardrop fashion by moving the hot-wire through a tear-drop path during the cutting operation.

Slots could also be cut in a two-step process, which process is presently preferred. In this process, a set of wires is arranged in a parallel array. The wires are heated. The heated wires cut the first set of slots. The relative orientation between the mattress component being cut, and the wires, is shifted by approximately 90 degrees, and the second set of slots are then also cut by the same heated wire array.

Figure 4A:
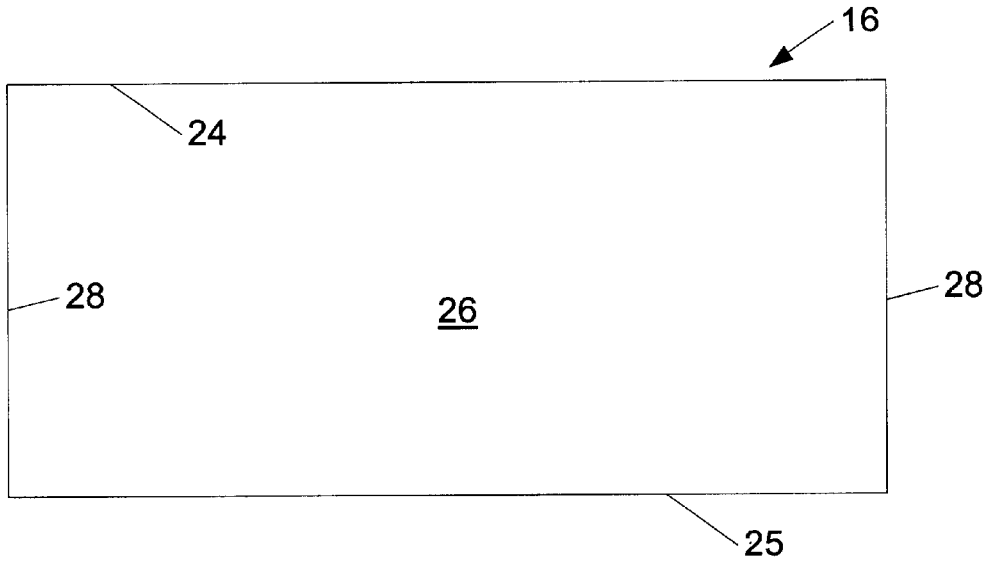
FIG. 4*a* is a top plan view of the foot cushion insert component of the present invention.
Figure 4B:
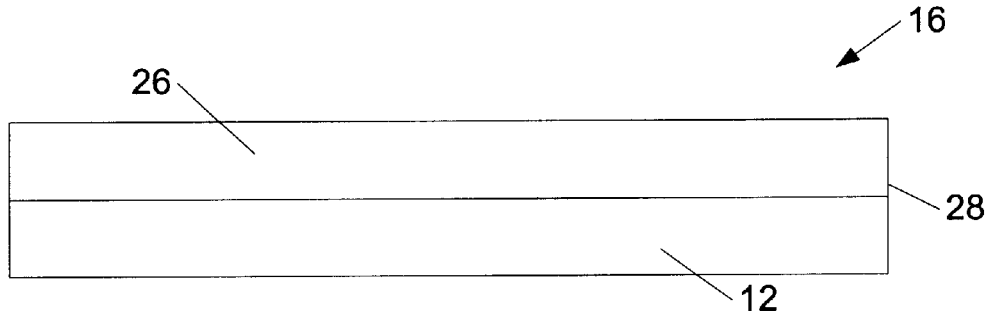
FIG. 4*b* is an end view of the foot cushion insert component of the present invention.
Figure 4C:
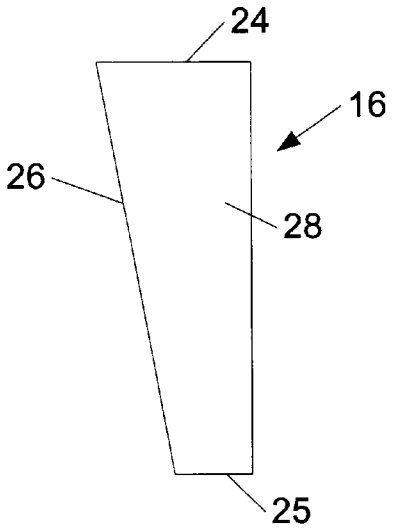
FIG. 4*c* is a side view of the foot cushion insert component of the present invention.

Reference is now made to FIGS. 4*a*–4*c* for a description of the structure and geometry of the foot cushion component 16 of the present invention. In FIG. 4*a,* top surface 26 of foot cushion 16 is displayed. The dimensions of insert 16 are defined primarily by the width of the assembled foam mattress, which, in the preferred embodiment, is approximately 35". The short dimension of the upper surface 26 of foot cushion 16 is approximately 16" but is sloped as described in more detail below.

Foot cushion 16 is a generally rectangular foam solid who's top surface 26 that inclines downward from thick end wall 24 towards thin end wall 25, which comprises the outward edge the insert. This downward inclination provides what has been found to be an appropriate pressure relief for the heels of a patient positioned on the mattress 11 of the present embodiment 10. The thickness of the foot cushion at its thickest dimension, the edge of thick end wall 24 where it abuts support cushion 14, is approximately the same as the thickness of body support cushion 14.

FIG. 4*b* is an end view of foot cushion component 16 of the present invention showing thin end wall 25 and sloping upper surface 26. Thin end wall 25 has a thickness approximately one-half that of the thickness of foot cushion 16 where it meets with support cushion 14, at thick end wall 24, as previously discussed. This provides adequate inclination to upper surface 26 for insert 16 as described above.

FIG. 4*c* is a side view of foot cushion 16 showing in detail the inclined upper surface 26 sloping downward toward thin end wall 25. While this inclined surface has been shown to have beneficial pressure relieving characteristics, it is of course possible to simplify the structure further by using a rectangular foam core with an orthogonal top surface.

Figure 5A:
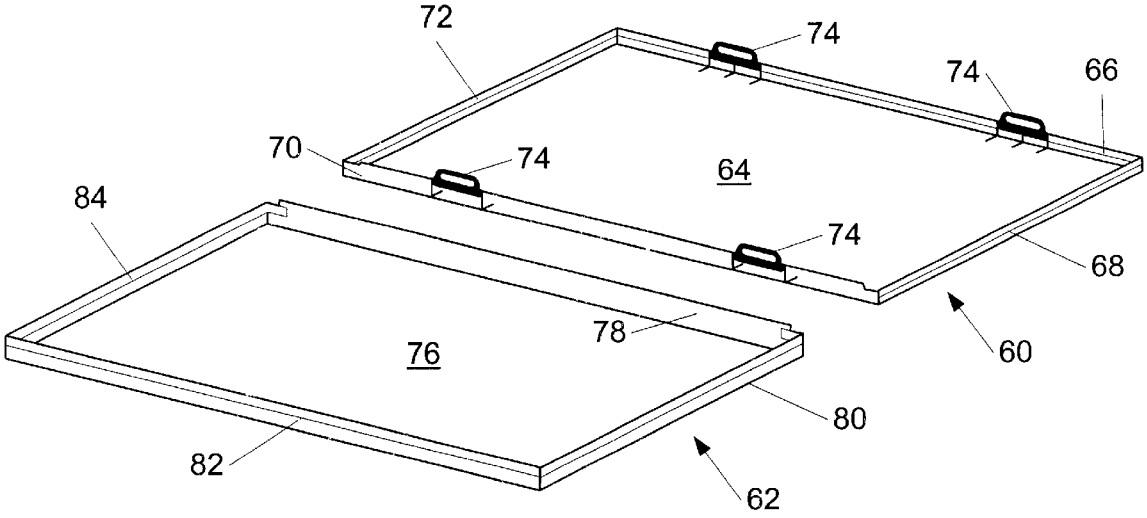
FIG. 5*a* is an exploded view of the upper and lower components of a cover appropriate for use in conjunction with the present invention.
Figure 5B:
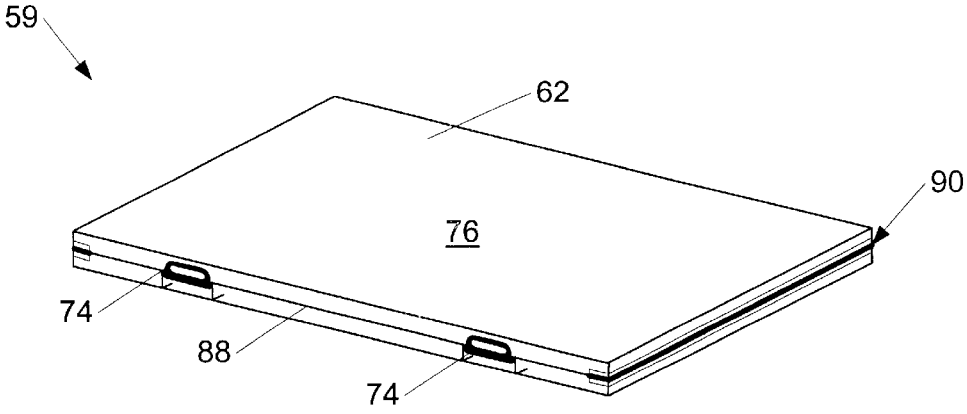
FIG. 5*b* is an assembled view of the cover shown in FIG. 5*a*.

Reference is now made briefly to FIGS. 5*a* and 5*b,* which disclose the structure of an appropriate fabric cover 60 for enveloping the mattress assembly 11 of the present invention. The cover shown in FIGS. 5*a* and 5*b* is well known in the art and is marketed in conjunction with various mattresses under the trademark THERAREST® manufactured and sold by Kinetic Concepts, Inc. of San Antonio, Tex., the applicant, and assignee of the present invention.

The basic structure of the fabric cover 60 comprises two components; a lower component 61 is matched with and mated to an upper component 62. Lower component 61 comprises a bottom cover material 64 having sidewalls 66, 68, 70, and 72. In the preferred embodiment, bottom cover material 64 is manufactured from a laminated vinyl fabric material, possibly double laminated vinyl material, and has surface dimensions generally equal to those dimensions for the foam mattress, namely 35"×80". Lower component 61 also contains a plurality of lifting straps 74 that are attached, possibly by stitching, on to the fabric of lower component 60 and facilitate the movement and positioning of the assembled and enclosed mattress. Upper component 62 comprises top cover material 76 and sidewalls 78, 80, 82, and 84. In a preferred embodiment, top cover material (76) is manufactured from a poly/nylon denim fabric and is sewn in the configuration shown in FIG. 5*a*.

Upper component 62 is permanently and fixedly attached to lower component 61 along a "non-zipper" side of the enclosure 88 (best seen in FIG. 5*b*). This side thereby becomes a "hinge" side of the enclosure and permits the assembled cover to encompass the assembled foam cushion components mating zipper components 90 sewn on to upper cover component 62 and lower cover component 61 provide means for repeatedly opening and closing the cover.

FIG. 5*b* also shows the assembled mattress cover with top cover material 76 exposed as indicated. As mentioned above, zipper 90 is shown positioned around approximately three-fourths of the perimeter of the cover to provide closure to the fabric material around the foam components described above. The fabric should have no tension on the surface upon which the patient is intended to rest, so as not to interfere with the therapeutic action of the present invention.

From the foregoing, it is readily apparent that a new and useful embodiment of the present invention has been herein described and illustrated which fulfills all of the aforestated objects in a remarkably unexpected fashion. It is of course understood that such modifications, alterations and adaptations as may readily occur to the artisan confronted with this disclosure are intended within the spirit of this disclosure, which is limited only by the scope of the claims appended hereto.

Accordingly the following is claimed:

1. A method of alleviating or preventing decubitis ulcer formation comprising placing an individual confined to a bed on a mattress assembly comprising a cushioning base, a body cushion attached thereto in partial registry therewith, a foot cushion insert attached to both said base and said body cushion, so that said body cushion comprises the majority of the top of said mattress, said body cushion is in registry with the top edge and side edges of said base, said foot cushion insert both abuts said body cushion and is in registry with the bottom of said base and the side edges thereof; said cushioning base, said body cushion and said foot cushion insert are secured to one another in an assembly so as to maintain relative registry; and said assembly is secured with an enveloping cover, wherein a plurality of slots in said body cushion create a plurality of pressure relieving partially independent pillars, and wherein the density of the foot cushion is greater than the density of the body cushion.

2. A method of alleviating or preventing decubitis ulcer formation comprising placing an individual confined to a bed on a mattress assembly comprising a cushioning base, a body cushion attached thereto in partial registry therewith, a foot cushion insert attached to both said base and said body cushion, so that said body cushion comprises the majority of the top of said mattress, said body cushion is in registry with the top edge and side edges of said base, and said foot cushion insert both abuts said body cushion and is in registry with the bottom of said base and the side edges thereof; wherein a plurality of slots in at least one of said cushioning base and body cushion create a plurality of pressure relieving partially independent pillars; and wherein the foot cushion has a top surface that inclines from a lateral edge of the cushioning base up to a lateral edge of the body cushion.

* * * * *